US011066621B2

(12) United States Patent
Shimizu et al.

(10) Patent No.: US 11,066,621 B2
(45) Date of Patent: Jul. 20, 2021

(54) LUBRICATING OIL COMPOSITION

(71) Applicant: Kyodo Yushi Co., Ltd., Fujisawa (JP)

(72) Inventors: Takafumi Shimizu, Fujisawa (JP); Takahiro Nihira, Tokyo (JP)

(73) Assignee: KYODO YUSHI CO., LTD., Fujisawa (JP)

( * ) Notice: Subject to any disclaimer, the term of this patent is extended or adjusted under 35 U.S.C. 154(b) by 0 days.

(21) Appl. No.: 16/489,486

(22) PCT Filed: Mar. 30, 2018

(86) PCT No.: PCT/JP2018/013906

§ 371 (c)(1),
(2) Date: Aug. 28, 2019

(87) PCT Pub. No.: WO2018/181994

PCT Pub. Date: Oct. 4, 2018

(65) Prior Publication Data

US 2020/0048575 A1 Feb. 13, 2020

(30) Foreign Application Priority Data

Mar. 31, 2017 (JP) ..... JP2017-070689

(51) Int. Cl.

| | |
|---|---|
| ***C10M 169/04*** | (2006.01) |
| ***C10M 135/18*** | (2006.01) |
| ***C10N 50/10*** | (2006.01) |
| ***C10N 40/25*** | (2006.01) |

(52) U.S. Cl.

CPC ..... *C10M 169/04* (2013.01); *C10M 135/18* (2013.01); *C10M 2205/0285* (2013.01); *C10M 2207/12* (2013.01); *C10M 2219/068* (2013.01); *C10M 2227/066* (2013.01); *C10N 2040/25* (2013.01); *C10N 2050/10* (2013.01)

(58) Field of Classification Search

CPC ..... C10M 169/04; C10M 135/18; C10M 2205/0285; C10M 2207/12; C10M 2207/126; C10M 2219/068; C10M 2227/066; C10N 2040/25; C10N 2050/10

See application file for complete search history.

(56) References Cited

U.S. PATENT DOCUMENTS 3,634,238 A * 1/1972 Bridger et al. ..... C10M 129/40 508/151
4,438,038 A * 3/1984 Petronella ..... B01J 23/04 554/74
5,205,951 A * 4/1993 MacKinnon ..... C10M 169/048 252/78.5
5,786,307 A 7/1998 Igarashi et al.
5,922,654 A 7/1999 Yamazaki et al.
5,994,277 A * 11/1999 Ritchie ..... C10M 133/12 508/365
2004/0087452 A1 5/2004 Noles et al.
2004/0144952 A1* 7/2004 Stewart ..... C10M 137/10 252/68
2005/0241990 A1* 11/2005 Ziemer ..... C10M 111/04 208/19
2009/0016652 A1* 1/2009 Endo ..... C10M 135/18 384/13
2012/0264666 A1* 10/2012 Donnelly ..... C10M 135/18 508/363
2013/0150607 A1* 6/2013 Winsett ..... C10M 177/00 558/260
2018/0194707 A1* 7/2018 Burrows ..... C10M 129/32

FOREIGN PATENT DOCUMENTS

| | | | |
|---|---|---|---|
| CN | 106367170 | A | 2/2017 |
| EP | 0 770 668 | A1 | 5/1997 |
| EP | 1 416 034 | A1 | 5/2004 |
| EP | 2 028 254 | A2 | 2/2009 |
| EP | 3 115 443 | A1 | 1/2017 |
| JP | H10121078 | A | 5/1998 |
| JP | H11140479 | A | 5/1999 |
| JP | H11140480 | A | 5/1999 |
| JP | 2008255160 | A | 10/2008 |
| JP | 2009161685 | A | 7/2009 |

OTHER PUBLICATIONS

International Search Report (PCT/ISA/210) dated Jun. 19, 2018, by the Japanese Patent Office as the International Searching Authority for International Application No. PCT/JP2018/013906.

Written Opinion (PCT/ISA/237) dated Jun. 19, 2018, by the Japanese Patent Office as the International Searching Authority for International Application No. PCT/JP2018/013906.

The Extended European Search Report dated Nov. 12, 2020, by the European Patent Office in corresponding European Patent Application No. 18776559.9. (9 pages).

* cited by examiner

*Primary Examiner* — James C Goloboy

(74) *Attorney, Agent, or Firm* — Buchanan, Ingersoll & Rooney PC

(57) ABSTRACT

The present invention provides a lubricating oil composition not containing ZnDTP but comprising: (a) a base oil; (b) molybdenum dialkyldithiocarbamate; and (c) an organic acid metal salt compound having a metal of Group 8 of a short periodic table, copper, or bismuth as a central metal.

17 Claims, No Drawings

LUBRICATING OIL COMPOSITION

TECHNICAL FIELD

The present invention relates to a lubricating oil composition which can be used in a wide range of fields such as lubricating oils for internal combustion engines. More particularly, the present invention relates to a lubricating oil composition containing an additive which can, in combination with molybdenum dialkyldithiocarbamate (MoDTC), achieve a friction reduction effect even at a lower temperature than the case where MoDTC is added alone to a base oil.

BACKGROUND ART

Due to environmental measures for automobiles (reduction of $CO_2$ emissions), the required fuel efficiency performance has been increasing year by year. It is important to reduce power loss, specifically friction loss, in order to improve fuel consumption performance, and automobile manufacturers have been improving power systems and lubricant manufacturers have been developing high-performance lubricants.

MoDTC is widely used as a friction modifier for high-performance lubricants. Although the friction reduction mechanism of MoDTC is not well understood, it is widely known to react on a lubricating surface to form molybdenum disulfide (hereinafter abbreviated as "$MoS_2$") known as a solid lubricant.

However, MoDTC has characteristics that, at low temperatures, its reactivity is low and it is difficult to obtain a friction reduction effect, so that it is mainly suitable for applications at high temperatures.

Meanwhile, the engine oil temperature does not easily rise due to eco-friendly car technology such as idling stop which has begun to spread in recent years. Moreover, many of the usage scenes of automobiles are short-distance driving, and even in such a situation, the engine oil temperature does not easily rise.

Numerous inventions have been made to reduce the coefficient of friction by the combination of MoDTC and additives. For example, although an invention of combining MoDTC and an organic acid metal salt compound has been reported (Patent Literature 1), the test implementation temperature in Patent Literature 1 was 80° C. or 120° C., and the test was not conducted at temperatures lower than 80° C.

The applicant of Patent Literature 1 described above has also reported an invention (Patent Literature 2) of combining MoDTC, an organic acid salt, and zinc dithiophosphate (ZnDTP). The test implementation temperature in Patent Literature 2 is 25° C., 80° C., or 120° C. ZnDTP, which is an essential component of Patent Literature 2, is known as an extreme pressure agent, and is used in many lubricants including engine oil. However, there is a concern of catalyst poisoning caused by phosphorus, and attention must be paid to the amount used.

CITATION LIST

Patent Literatures

Patent Literature 1: Japanese Patent Application Publication No. Hei 11-140480

Patent Literature 2: Japanese Patent Application Publication No. Hei 11-140479

SUMMARY OF INVENTION

Problems to be Solved by the Invention

It is difficult to lower the coefficient of friction in a low-temperature region without using ZnDTP. Under such circumstances, it is considered that exhibiting the friction reduction effect of a lubricating oil composition without using ZnDTP at a temperature lower than before contributes to improving the fuel consumption performance of automobiles including eco-friendly cars and to extending the life of catalysts used as an exhaust gas aftertreatment device.

In view of the above, the present invention aims to provide a lubricating oil composition which uses an additive that can exhibit a friction reduction effect even at a temperature lower than the point exhibiting a friction coefficient reduction effect in the case where MoDTC alone is added as a friction reduction agent to the base oil without using ZnDTP.

Means for Solution of the Problems

Therefore, the present inventors have made earnest studies on a lubricating oil composition containing MoDTC in order to solve the above-described problem, and have found as a result that, if MoDTC is combined with a specific organic acid metal salt compound, it is possible to exhibit a friction reduction effect even at a temperature lower than the point exhibiting a friction coefficient reduction effect in the case where MoDTC alone is added to the base oil as a friction reduction agent. Moreover, the present inventors have found that there is a certain correlation between the low oxidation potential of the metal of such organic acid metal salt compound and the low coefficient of friction at low temperatures of the base oil prepared by mixing MoDTC and the organic acid metal salt compound.

Specifically, the present invention provides a lubricating oil composition presented in the following 1. to 3.

1. A lubricating oil composition not containing ZnDTP but comprising the following components (a) to (c):
(a) a base oil;
(b) molybdenum dialkyldithiocarbamate; and
(c) an organic acid metal salt compound having a metal of Group 8 of a short periodic table, copper, or bismuth as a central metal.
2. The lubricating oil composition according to 1 described above, wherein the (c) is an organic acid metal salt compound having a metal of Group 8 of the short periodic table as a central metal.
3. The lubricating oil composition according to 1 or 2 described above, wherein the organic acid metal salt compound is a compound whose oxidation potential of the central metal (a potential at which, when a valence of the central metal in the organic acid metal salt compound is X, the metal emits electrons from a zero-valent state to change to an X-valent metal cation) is +0.50 V (vs SHE) or less.
4. The lubricating oil composition according to any one of 1 to 3 described above, wherein a content of the organic acid metal salt compound in the composition is 100 to 1000 ppm in terms of central metal element concentration.

Advantageous Effects of Invention

The lubricating oil composition of the present invention makes it possible to obtain a friction reduction effect at a lower temperature than the case where MoDTC alone is added to the base oil as a friction reduction agent while extending the life of the catalyst.

DESCRIPTION OF EMBODIMENTS

The base oil as the above component (a) includes, but is not limited to commonly used lubricating base oils such as mineral oils, ether-based synthetic oils, ester-based synthetic oils, and hydrocarbon-based synthetic oils or oil mixtures thereof. Among them, synthetic oils are preferable, hydrocarbon-based synthetic oils are more preferable, and poly α-olefins are particularly preferable.

The kinematic viscosity of the base oil at 40° C. is not particularly limited, but is preferably 5 to 400 $mm^2/s$, more preferably 5 to 200 $mm^2/s$, and further preferably 5 to 70 $mm^2/s$. The kinematic viscosity is preferably in the above ranges because MoDTC can form a film efficiently on the lubricating surface.

The content of the component (a) in the composition of the present invention is generally a major amount which is an amount larger than those of the components (b) and (c), and is preferably 40% by mass or more, more preferably 40 to 99.5% by mass, and most preferably 40 to 90% by mass.

MoDTC as the component (b) is preferably molybdenum dialkyldithiocarbamate represented by following formula (1)

$$(R_1R_2N—CS—S)_2—Mo_2O_mS_n \quad (1),$$

where $R_1$ and $R_2$ independently represent an alkyl group having 1 to 24 carbon atoms and preferably 2 to 18 carbon atoms, m is 0 to 3, n is 4 to 1, and m+n=4.

The content of MoDTC described above in the composition of the present invention is preferably 0.1 to 10% by mass, more preferably 0.1 to 5% by mass, and further preferably 0.1 to 0.5% by mass. These ranges are preferable because it is possible to exhibit a friction reduction effect at an economically rational concentration.

The organic acid metal salt compound, which is the component (c) having a metal of Group 8 of the short periodic table, copper, or bismuth as a central metal, is preferably a compound whose oxidation potential of the central metal (a potential at which, when a valence of the central metal in the organic acid metal salt compound is X, the metal emits electrons from a zero-valent state to change to an X-valent metal cation) is +0.5 V (vs SHE) or less.

The central metal constituting the organic acid metal salt compound is preferably a metal of Group 8 of the short periodic table. The metal of Group 8 is particularly preferably iron (oxidation potential: +0.440 V (vs SHE)), cobalt (oxidation potential: +0.277 V (vs SHE), and nickel (oxidation potential: +0.250 V (vs SHE)). Further, nickel is particularly preferable. Note that the oxidation potentials described herein are values described in Sakichi Goto, edited by the Chemical Society of Japan, "Kinzoku no Kagaku," p 18-21, Dainippon Tosho Publishing Co., Ltd. (1971) or edited by Electrochemical Society of Japan, "Denki Kagaku Binran." Sixth Edition. p 92-95. Maruzen Publishing Co., Ltd. (2013).

The organic acid constituting the organic acid metal salt compound can be represented by the following formula (2), and can include aliphatic carboxylic acids, alicyclic carboxylic acids, and aromatic carboxylic acids. In addition, any of monocarboxylic acids, dicarboxylic acids, other polycarboxylic acids, and the like may be used, and saturated or unsaturated carboxylic acids are also used.

$$R_3(COOH)_p \quad (2)$$

where $R_3$ is a saturated or unsaturated aliphatic hydrocarbon group having 1 to 30 carbon atoms, or an alicyclic hydrocarbon group or an aromatic hydrocarbon group substituted with at least one chained saturated or unsaturated hydrocarbon group, the alicyclic hydrocarbon group or the aromatic hydrocarbon group having 1 to 30 carbon atoms in total. A saturated or unsaturated aliphatic hydrocarbon group having 1 to 30 carbon atoms is preferable. A linear or branched alkyl group having 1 to 30 carbon atoms is preferable. A branched alkyl group having 1 to 18 carbon atoms is more preferable. A branched alkyl group having 1 to 10 carbon atoms is more preferable. The value p is an integer of 1 to 4, and p is particularly preferably 1.

Specific examples of the component (c) of the present invention include cobalt salts, nickel salts, copper salts, and bismuth salts of the above-described carboxylic acids, and the like. Among them, cobalt 2-ethylhexanoate, nickel 2-ethylhexanoate, copper neodecanoate, and bismuth 2-ethylhexanoate are preferable. Cobalt 2-ethylhexanoate and nickel 2-ethylhexanoate are particularly preferable.

The content of the component (c) in the composition of the present invention is preferably 50 to 5000 ppm, more preferably 50 to 3000 ppm, further preferably 100 to 1000 ppm, and particularly preferably 200 to 500 ppm in terms of central metal element concentration. These ranges make it possible to exhibit a friction reduction effect without inhibiting the reaction on the lubricating surface of MoDTC. In particular, the content is preferably 200 to 500 ppm in the case where the central metal is an element of Group 8, the content is preferably 100 to 250 ppm in the case of copper, and the content is preferably 100 to 250 ppm in the case of bismuth. The concentration of the component (c) in terms of central metal element is preferably lower than the concentration of the component (b) in terms of molybdenum, and when the concentration of the component (c) in terms of central metal element is set to 1, the concentration of the component (b) in terms of molybdenum is 0.1 to 10 and preferably 0.2 to 5. The content of the component (c) and the component (b) is preferably in those ranges because it is possible to exhibit a friction reduction effect without inhibiting the reaction on the lubricating surface of MoDTC.

The lubricating oil composition of the present invention does not contain ZnDTP, and this means that it does not contain such an amount of ZnDTP that causes loss of catalytic activity.

In the lubricating oil composition of the present invention, when necessary, it is possible to appropriately select and further blend a viscosity index improver, an ashless dispersant, an antioxidant, an extreme pressure agent, an anti-wear agent, a metal deactivator, a pour point depressant, an anti-corrosion agent, other friction modifier, or the like. If the lubricating oil composition of the present invention contains optional additives, they are usually used at a proportion of 25% by weight or less in total of MoDTC and these additives excluding the viscosity index improver.

Viscosity index improvers usable include, for example, those of polymethacrylate type, polyisobutylene type, ethylene-propylene copolymer type, styrene-butadiene hydrogenated copolymer type, and the like, and these are usually used at a proportion of 3% by weight to 30% by weight.

Ashless dispersants include, for example, those of polybutenyl succinimide type, polybutenyl succinic acid amide type, benzylamine type, and succinic acid ester type, and these are usually used at a proportion of 0.05% by weight to 7% by weight.

Antioxidants can include, for example, amine-based antioxidants such as alkylated diphenylamines, phenyl-α-naphthylamine, and alkylated phenyl-α-naphthylamines, phenolic antioxidants such as 2,6-di-t-butylphenol and 4,4'-methylenebis-(2,6-di-t-butylphenol), and the like, and these are usually used at a proportion of 0.05% by weight to 5% by weight.

Extreme pressure agents include, for example, dibenzyl sulfide, dibutyl disulfide, and the like, and these are usually used at a proportion of 0.05% by weight to 3% by weight.

Metal deactivators include, for example, benzotriazole, benzotriazole derivatives, thiadiazoles, and the like, and these are usually used at a proportion of 0.01% by weight to 3% by weight.

Pour point depressants include, for example, ethylene-vinyl acetate copolymers, condensates of chlorinated paraffin and naphthalene, condensates of chlorinated paraffin and phenol, polymethactylates, polyalkylstyrenes, and the like, and these are usually used at a proportion of 0.1% by weight to 10% by weight.

Anti-wear agents include, for example, phosphoric acid esters, acidic phosphoric acid esters, phosphorous acid esters, acidic phosphorous acid esters, zinc dialkyl dithiophosphates, sulfur compounds, and the like, and these are usually used at a proportion of 0.01% by weight to 5% by weight.

As other additives, any additives can be selected and used as long as they do not inhibit the action of MoDTC and the organic acid salt metal compound of the present invention.

The lubricating oil composition of the present invention is preferably used by being added to an engine oil. The lubricating oil composition of the present invention can also be applied as it is, or a thickener can be added to form a grease composition. When the lubricating oil composition of the present invention is applied as it is, a coating is formed on a resin surface or a metal surface of a bearing or the like. Thickeners which can be used to form a grease composition include metal soaps such as Li soap, and diurea compounds such as aliphatic diurea, alicyclic diurea, aromatic diurea, or mixtures thereof. Those skilled in the art can appropriately determine the penetration of a grease composition (60-stroke worked penetration measured by JIS K2220 7.) and the proportion of the thickener according to the application site of the grease.

EXAMPLES

Next, the present invention is further specifically described with reference to Examples and Comparative Examples. The conditions and method of measuring the coefficient of friction of the base oils, MoDTC, organometallic compounds, and lubricating oil compositions used in Examples and Comparative Examples are as follows.

[Lubricating Base Oil]

α-olefin oligomer (kinematic viscosity (@ 40° C.) 48.5 $mm^2/s$) (hereinafter abbreviated as "PAO")

[MoDTC]

MoDTC: molybdenum dialkyldithiocarbamate (the structure is as in the formula (1))

[Organic Acid Salt Compound]

Ni-OCTOATE (salt whose central metal is Ni and organic acid is 2-ethylhexanoic acid)

Co-OCTOATE (salt whose central metal is Co and organic acid is 2-ethylhexanoic acid)

Cu neodecanoate (salt whose central metal is Cu and organic acid is neodecanoic acid)

Bi-OCTOATE (salt whose central metal is Bi and organic acid is 2-ethylhexanoic acid)

Zn-OCTOATE (salt whose central metal is Zn and organic acid is 2-ethylhexanoic acid)

Mn-OCTOATE (salt whose central metal is Mn and organic acid is 2-ethylhexanoic acid)

Zr-OCTOATE (salt whose central metal is Zr and organic acid is 2-ethylhexanoic acid)

Note that each of the MoDTC concentrations (% by weight) in the tables is 200 ppm in terms of Mo concentration.

[Method of Measuring Coefficient of Friction]

The coefficient of friction was measured under the following conditions using a ball-on-disk tester.

Friction material: steel (SUJ-2)/steel (SUJ-2), φ 8 mm ball/disk

Temperature: 60° C. and 80° C.

Load: 10 N

Speed: 0.5 m/s

Time: 30 min

The average value during the last 5 minutes of the 30 minute measurement was used as the measured value of the coefficient of friction.

Comparative Example 1 and Examples

Comparative Example 1 used PAO as a lubricating base oil, which was blended with 0.4% by weight of MoDTC. In Examples, organic acid metal salt compounds were further blended at the proportions presented in Table 1.

The coefficients of friction of the resulting lubricating oil compositions were measured. Comparative Example 1 exhibited a good coefficient of friction at 80° C., and exhibited a higher value at 60° C. than the coefficient of friction at 80° C. Therefore, it is considered that, in the case of MoDTC alone, a friction reduction effect is exhibited around 80° C. On the other hand, at 80° C. and 60° C., Examples exhibited coefficients of friction similar to the coefficient of friction of Comparative Example 1 at 80° C. From the above, it has been found that, in combination with an organic acid metal salt compound, it is possible to obtain a friction reduction effect even at a lower temperature than the case where MoDTC alone is added to the base oil.

Comparative Examples 2 to 7

PAO was used as a lubricating base oil, which was blended with 0.4% by weight of MoDTC and further with organic acid metal salt compounds in the proportions presented in Table 2.

The coefficients of friction of the resulting lubricating oil compositions were measured. In each case, the coefficient of friction at 60° C. was higher than the coefficient of friction at 80° C. Therefore, it is considered that, as in Comparative Example 1, the lubricating oil compositions of Comparative Examples 2 to 7 exhibit a friction reduction effect around 80° C.

For the metal elements of the organic acid metal salts used in Examples and Comparative Examples 2 to 7, the oxidation potentials (Sakichi Goto, edited by the Chemical Society of Japan, "Kinzoku no Kagaku," p 18-21, Dainippon Tosho Publishing Co., Ltd. (1971)) and the coefficients of friction of the corresponding metal cations were compared. Then, the lower the oxidation potential, the lower the coefficient of friction at low temperature when combined with MoDTC. From the experimental results of the present inventors, the threshold of the oxidation potential of the metal cation exhibiting the above effect is estimated to be between +0.763 V of Zn-OCTOATE (salt of $Zn^{2+}$) and +0.277 V of Co-OCTOATE (salt of $Co^{2+}$).

TABLE 1

| | | Comp. Ex. 1 | Ex. 2 | Ex. 3 | Ex. 4 | Ex. 5 | Ex. 6 | Ex. 7 |
|---|---|---|---|---|---|---|---|---|
| PAO | | Balance | Balance | Balance | Balance | Balance | Balance | Balance |
| MoDTC % by Weight | | 0.4 | 0.4 | 0.4 | 0.4 | 0.4 | 0.4 | 0.4 |
| Organic Acid Metal Salt Compound Metal Content (ppm) | | | | | | | | |
| Ni-OCTOATE | | | 500 | 200 | | | | |
| Co-OCTOATE | | | | | 500 | 200 | | |
| Cu Neodecanoate | | | | | | | 200 | |
| Bi-OCTOATE | | | | | | | | 200 |
| Oxidation Potential of Organic Acid Metal Salt Compound (V vs. SHE) | | — | +0.250 | +0.250 | +0.277 | +0.277 | −0.340 | −0.317 |
| Metal Content Ratio Mo [ppm]/(Metal Content of Organic Acid Metal Salt) [ppm] | | — | 2.5 | 1.0 | 2.5 | 1.0 | 1.0 | 1.0 |
| Coefficient of Friction | 60° C. | Δ | ○ | ○ | ○ | ○ | ○ | ○ |
| | 80° C. | ○ | ○ | ○ | ○ | ○ | ○ | ○ |

The coefficient of friction in the table: ○ means 0.060 or less. Δ means 0.061 to 0.100, and x means 0.101 or more.

The values of the oxidation potentials of the organic acid metal salt compounds were taken from the above-described "Kinzoku no Kagaku" or "Denki Kagaku Binran."

TABLE 2

| | | Comp. Ex. 2 | Comp. Ex. 3 | Comp. Ex. 4 | Comp. Ex. 5 | Comp. Ex. 6 | Comp. Ex. 7 |
|---|---|---|---|---|---|---|---|
| PAO | | Balance | Balance | Balance | Balance | Balance | Balance |
| MoDTC % by Weight | | 0.4 | 0.4 | 0.4 | 0.4 | 0.4 | 0.4 |
| Organic Acid Metal Salt Compound Metal Content (ppm) | | | | | | | |
| Zn-OCTOATE | | 500 | 200 | | | | |
| Mn-OCTOATE | | | | 500 | 200 | | |
| Zr-OCTOATE | | | | | | 500 | 200 |
| Organic Acid Metal Oxidation Potential of Organic Acid Metal Salt Compound (V vs. SHE) | | +0.763 | +0.763 | +1.18 | +1.18 | +1.58 | +1.58 |
| Metal Content Ratio Mo [ppm]/(Metal Content of Organic Acid Metal Salt) [ppm] | | 2.5 | 1.0 | 2.5 | 1.0 | 2.5 | 1.0 |
| Coefficient of Friction | 60° C. | Δ | Δ | X | Δ | X | Δ |
| | 80° C. | ○ | ○ | ○ | ○ | Δ | ○ |

The coefficient of friction in the table: ○ means 0.060 or less. Δ means 0.061 to 0.100, and x means 0.101 or more.

The values of the oxidation potentials of the organic acid metal salt compounds were taken from the above-described "Kinzoku no Kagaku" or "Denki Kagaku Binran."

What is claimed is:

1. A lubricating oil composition not containing ZnDTP but comprising the following components (a) to (c):

(a) a base oil;

(b) molybdenum dialkyldithiocarbamate; and (c) an organic acid metal salt compound which is nickel 2-ethylhexanoate, wherein a content of the molybdenum dialkyldithiocarbamate in the composition is 0.1 to 0.5 mass %, and a content of the organic acid metal salt compound in the composition is 200 to 500 ppm in terms of nickel concentration, and wherein the lubricating oil composition is free of an amine-based antioxidant.

2. The lubricating oil composition according to claim 1, wherein the base oil is synthetic oil.

3. The lubricating oil composition according to claim 1, wherein the base oil is poly alpha olefin.

4. The lubricating oil composition according to claim 1, wherein a content of the base oil is 40 mass % or more.

5. A grease composition comprising the lubricating oil composition according to claim 1, and a thickener.

6. The lubricating oil composition according to claim 1, wherein the content of the molybdenum dialkyldithiocarbamate is 0.4 mass %.

7. The lubricating oil composition according to claim 1, wherein the lubricating oil composition has a coefficient of friction measured using a ball-on-disk tester under following conditions of 0.060 or less, Friction material: steel (SUJ-2)/steel (SUJ-2, φ 8 mm ball/disk, Temperature: 60° C., Load: 10 N, Speed: 0.5 m/s, and Time: 30 min.

8. A lubricating oil composition not containing ZnDTP but comprising the following components (a) to (c):

(a) a base oil;

(b) molybdenum dialkyldithiocarbamate; and (c) an organic acid metal salt compound which is cobalt 2-ethylhexanoate, wherein a content of the organic acid metal salt compound in the composition is 100 to 1000 ppm in terms of cobalt concentration, and wherein the lubricating oil composition is free of an anime-based antioxidant.

9. The lubricating oil composition according to claim 8, wherein the lubricating oil composition has a coefficient of friction measured using a ball-on-disk tester under the following conditions of 0.060 or less;

Friction material: steel (SUJ-2)/steel (SUJ-2, φ 8 mm ball/disk,

Temperature: 60° C.,

Load: 10 N,

Speed: 0.5 m/s, and

Time: 30 min.

10. The lubricating oil composition according to claim 8, wherein the base oil is synthetic oil.

11. The lubricating oil composition according to claim 8, wherein the base oil is poly alpha olefin.

12. The lubricating oil composition according to claim 8, wherein a content of the base oil is 40 mass % or more.

13. The lubricating oil composition according to claim 8, wherein a content of the molybdenum dialkyldithiocarbamate in the composition is 0.1 to 10 mass % or more.

14. The lubricating oil composition according to claim 8, wherein a content of the molybdenum dialkyldithiocarbamate in the composition is 0.1 to 0.5 mass %.

15. The lubricating oil composition according to claim 8, wherein the content of the organic acid metal salt compound in the composition is 100 to 500 ppm in terms of cobalt concentration.

16. The lubricating oil composition according to claim 8, wherein the content of the organic acid metal salt compound in the composition is 200 to 500 ppm in terms of cobalt concentration.

17. A grease composition comprising a lubricating oil composition not containing ZnDTP but comprising the follow components (a) to (c);

(a) a base oil;

(b) molybdenum dialkyldithiocarbamate; and (c) an organic acid metal salt compound which is cobalt 2-ethylhexanoate, wherein a content of the organic acid metal salt compound in the composition is 100 to 1000 ppm in terms of cobalt concentration, and a thickener.

* * * * *